US005939367A

United States Patent [19]

Cuse

[11] Patent Number: 5,939,367

[45] Date of Patent: Aug. 17, 1999

[54] LUBRICANT FOR USE IN THE BEARING AREA BETWEEN VEHICLES, TYPICALLY TRUCKS AND TRAILERS

[76] Inventor: Arthur R. Cuse, 336 S. Occidental Blvd., Los Angeles, Calif. 90057

[21] Appl. No.: 08/997,194

[22] Filed: Dec. 23, 1997

Related U.S. Application Data

[63] Continuation-in-part of application No. 08/489,608, Jun. 12, 1995, abandoned.

[51] Int. Cl.[6] ..... C10M 169/02

[52] U.S. Cl. ..... 508/591; 508/136; 508/451; 508/476

[58] Field of Search ..... 508/591

[56] References Cited

U.S. PATENT DOCUMENTS

| | | | |
|---|---|---|---|
| 3,098,042 | 7/1963 | Morway et al. | 252/39 |
| 3,728,261 | 4/1973 | Mitacek | 252/41 |
| 4,110,233 | 8/1978 | Bailey et al. | 252/41 |
| 4,462,918 | 7/1984 | Matthews et al. | 252/32.7 |
| 4,481,122 | 11/1984 | Root et al. | 252/32.7 |
| 5,151,205 | 9/1992 | Culpon, Jr. | 252/56 |
| 5,190,682 | 3/1993 | Harris | 252/56 |

*Primary Examiner*—Ellen M. McAvoy
*Attorney, Agent, or Firm*—Bruce A. Jagger

[57] ABSTRACT

A base material for a lubricant mixture or a lubricant for use in the fifth wheel plate/king pin plate bearing area including polybutene, polybutylene and/or other similar elastomer and/or viscous non drying liquid, the combined mixture with a Saybolt Universal viscosity at 99° C. using ASTM method D-2161, of greater than 500 SUS. In addition, the lubricant may include synthetic oil(s), mineral oil(s), natural oil(s), polyols and/or esters, in any combination, having a final, mixed or blended viscosity of between 2–60 measured in centistokes at 150° C. using ASTM method D-445 and thermoplastic polymer(s) and/or wax(es) with a melting point of between 160° F.–500° F. The above combination of materials may constitute 60 percent or more by weight of the final lubricant mixture.

8 Claims, No Drawings

LUBRICANT FOR USE IN THE BEARING AREA BETWEEN VEHICLES, TYPICALLY TRUCKS AND TRAILERS

This application is a continuation-in-part of application Ser. No. 08/489,608 filed on Jun. 12, 1995, now abandoned.

FIELD OF THE INVENTION

This invention relates to adhesive-lubricants specifically for use in the bearing area of slow speed, highly loaded bearing surfaces, such as, for example, those between the fifth wheel plate of a truck, truck tractor, or tractive power unit and the king pin plate of its trailer or hauled unit.

Research indicates significant breakdown and water washout of typical lubricants used in the fifth wheel plate/king pin plate bearing area. Both are enhanced by the extremely heavy compression and shear loads, and the mechanical working of the lubricant by the two bearing surfaces. This mechanical action also aids and accelerates any tendency of the lube, especially portions of the lube exposed to water or moisture in this open bearing system, to emulsify with water in that area. This emulsification can lower the viscosity of the lubricant and change adhesion and load carrying characteristics of the lube and contribute to premature lubricant breakdown in service. This can result in shorter lube service life, possible increased galling, scoring and/or wear of the bearing surface. Also, there can be high washoff from these bearing areas with high resultant pollution from this bearing system.

The problems of lubricating slow speed, highly loaded bearing surfaces occur in many applications. In some such application the bearings are open. In others they are not. The present invention is applicable to these other application.

BACKGROUND OF THE INVENTION

Historically, heavily loaded slow speed bearings, including, for example, the fifth wheel plate/trailer plate bearing connecting trucks and trailers have been lubricated with grease. In addition, due to the ready availability of chassis grease, where trucks and trailers are serviced, chassis grease has been and is used more frequently than any other grease.

Chassis grease or any standard grease or lubricant used to lubricate, for example, the fifth wheel plate/king pin plate bearing area does not have the mechanical or chemical characteristics that will provide lubrication in an efficient or environmentally safe manner. In order to produce an efficient and environmentally safe lubricant, particularly for fifth wheels, the basic problems and operation of this bearing area have to be addressed. The following areas are of concern.

(1) PROBLEMS OF LUBRICANT APPLICATION: Lubricating this bearing area has been and is generally accomplished by spreading grease on the fifth wheel plate. This is typically done by using an air or manual grease gun, by spreading grease obtained from a bucket or a barrel using a piece of corrugated paper or a wood board, or by squeezing grease directly out of a tube or a cartridge.

In any of the above application methods, the lubricant usually is not spread smoothly or evenly. It must be understood that grease application to this bearing area is not an enjoyable task. It is messy and therefore done as quickly as possible. Typically more grease is used than required or useful. This also leads to pollution problems. One attempt to make application easier is shown in Spiers Patent No. 4,913,263, issued Apr. 3, 1990, where lubricant is prepackaged in plastic bags that are placed on the fifth wheel surface. The Spiers patent covers packaging, rather than lube composition.

Because the application and use of grease in this bearing area has been such a problem, there have been a number of patents which have attempted to overcome the problem by using plastic plates instead of grease. See, for example, Franks Patent No. 3,275,390 issued Sep. 27, 1966, Lowry Patent No. 3,704,924 issued Dec. 5, 1972, Szalay et al Patent No. 4,169,635 issued Oct. 2, 1979, Hunger Patent No. 4,457,531 issued Jul. 3, 1984, St. Louis Patent No. 4,542,912 issued Sep. 24, 1985 and Mamery Patent No. 4,805,926 issued Feb. 21, 1989. The Lowry and Szalay et al patents show the typical structure for the fifth wheel plate/king pin plate bearing area and the showings in these patents may be incorporated for reference in this application. Substituting plastic plates instead of grease increases the separation of the fifth wheel truck plate and the trailer king pin plate. This changes the nature of contact between the trailer king pin and its clamping mechanism located under the truck fifth wheel plate and may create operational safety problems.

(2) PROBLEMS OF LUBRICANT LOSS WHEN COUPLING TRACTOR AND TRAILER: The usual method of coupling is to back the tractor up to and then partially under the front of the trailer, so that the fifth wheel plate of the tractor is in correct alignment and contact with the king pin plate located on the trailer. If this is not done with care, much of the grease applied to the fifth wheel plate will be scraped off before coupling of the two vehicles. The scraped off grease is useless for lubrication and becomes a polluting material. This will be further commented on in more detail.

A similar problem occurs with plastic plates. If the coupling alignment is not correct, backing the tractor under the trailer can peel off or tear the plastic plate.

(3) OPERATING CONDITIONS IN SERVICE: The relative velocity of the fifth wheel plate on the truck relative to the king pin plate on the trailer is very low, typically much less than one foot per second. This bearing area also has very limited rotation. The relative movement between the two bearing areas is actually oscillation and never complete rotation. This relative movement only occurs when the tractor and trailer turn. On long portions of interstate highway, there is very little turning and therefore very little movement or oscillation of the two bearing surfaces relative to each other for hours at a time. There is more relative motion in the bearing area on winding roads and city streets. However, even in 90 degree city street corners, turns are typically made wide with the relative motion at less than 90 degrees so as to clear the corners.

The low relative motion in the present invention may be compared to open gear systems as described in Harris Patent No. 5,190,682 issued Mar. 2, 1993.

In the fifth wheel plate/king pin plate bearing lubricant of the present invention, it is desirable that there is enough flow and adhesion of lubricant to keep the bearing surface covered while under the loading conditions previously described. Without flow and adhesion, lubricant wipe-off in certain loaded zones typically becomes a problem and can result in galling and wear. In U.S. Pat. No. 2,094,576, finely divided insoluble solid filler, repeatedly stated as asbestos, is considered highly desirable to press a grease into sticks, or retain a grease in plug valves and eliminate cold flow.

The combination of polybutene and/or oils and/or thermoplastic polymer(s) and/or wax(es) in the adhesive lubricant creates a base material and/or end product substantially different in character, behavior and flow than the polybutene, oil and fibrous filler specified in U.S. Pat. No. 2,094,576.

With the typical very slow and limited oscillation, vertical loading from heavy cargo, vibration and irregular shock and harmonic loading, the rocking loads of cross winds, plus dirt, snow, salt, rain, rocks and trash constantly thrown up by the drive wheels as well as airflow around an unsealed bearing area, it is not surprising that typical chassis grease or any standard grease or lubricant including open gear lubricant will not last a long time and will pollute.

Water washout of the lubricant used in open bearings such as, for example, the fifth wheel/king pin plate bearing area is enhanced by the extremely heavy compression and shear loads. This is the result of mechanical working of the lubricant by the two bearing surfaces. This mechanical action aids and accelerates any tendency of the lubricant, especially portions of the lubricant exposed to water or moisture in this open bearing system, to emulsify. Emulsification typically lowers the viscosity of the lubricant and changes adhesion and load carrying characteristics of the lubricant and therefore contributes to premature lubricant breakdown in service. Mechanical working plus possible emulsification results in shorter lubricant service life, possible increased galling, scoring and/or wear of areas of the bearing surface. There is high washoff from these bearing areas with high resultant pollution from this bearing system.

(4) POLLUTION PROBLEMS WITH GREASE: As previously mentioned, grease is typically over-applied to this fifth wheel plate/king pin plate bearing area. A portion of this grease is typically scraped off and/or squeezed out during and immediately after the coupling of the truck with the trailer. Oscillation and continual loading constantly squeeze much of the remaining lubricant out of the bearing area. Also, the open bearing is constantly subject to water washout plus other operating conditions previously described. All of the above results in lubrication of the bearing area to be typically accomplished by 25 percent or less of the grease initially applied.

Loads, weather, drivers, equipment, roads and traffic are different each day and affect the amount of grease used. However, from inquiries and observations made over a number of years, it is estimated that from one half to one tube of grease or its equivalent is typically used once per week per truck on the fifth wheel bearing surface. Each tube is typically 14 or 14.5 oz. net weight.

The water washout, vibration, squeeze-out from constant load, together with other conditions previously described, typically remove almost all of the grease applied to this open system bearing from the previous week. The removal typically happens whether or not any of the grease actually was useful and used in lubrication of the bearing surface.

Vehicle sales and registration data do not indicate the precise number of trucks in operation with a fifth wheel. However, trade estimates are in the area of 1–1.5 million trucks with such a fifth wheel. Assuming the lower figure of one million trucks, since substantially all of the grease applied to the fifth wheel bearing area eventually becomes pollution, this means approximately 23–45 million pounds of grease pollution in the U.S. per year from just this one bearing area using existing lubricants.

It will be appreciated that a somewhat extended description of the fifth wheel plate/king pin bearing plate bearing system and its operation have been included. The reasons are that the lubrication products of this invention are intended to solve severe mechanical and environmental problems with slow speed, heavily loaded bearing surfaces. Fifth wheels provide a good example of the service conditions where these adhesive-lubricants are particularly suited for use. The mechanical, operational and pollution problems of the fifth wheel bearing area appear to be particularly severe, and, therefore, require extensive comment. Further, due to the unusually harsh operating conditions and characteristics of this bearing area, long periods of field testing have proven invaluable to obtain data as well as to test lubricants which provide superior performance under real world operating conditions. The preferred embodiments of the present invention are the result of this extensive field testing.

SUMMARY OF THE INVENTION

It has been found that blends of certain fluid adhesive type materials, certain polybutenes, polybutylene, polyisobutylene, and/or other adhesives, together with certain thermoplastic(s) and/or wax(es) are effective base materials for adhesive lubricants designed specifically for use in slow speed, heavily loaded bearing surfaces, such as, for example, the fifth wheel plate/king pin plate bearing area between trucks and trailers. Field test results also indicate some blends of the above materials may provide lubricant properties for the fifth wheel bearing area with little or no oil or oil type materials.

The present invention produces a lubricant for the bearing area herein described, which is of such viscosity and adhesiveness so that the lube washoff and drop off under typical operating conditions are at least 80 percent less than typical truck chassis grease with a thickness rating of NLGI #2 (National Lubricating Grease Institute) under the same operating conditions.

In addition, the lubricant for bearing areas according to the present invention can consist of materials which in initial or combined form are not currently known or considered to be hazardous as defined by Federal, State and/or local regulations, and do not produce hazardous waste as currently known and defined by Federal, State and/or local regulations.

DESCRIPTION OF THE PREFERRED EMBODIMENTS

The present invention involves adhesive-lubricant mixtures for use as both base materials as well as final products for lubricating bearing surfaces, including, for example, the fifth wheel plate/king pin plate bearing area of trucks and trailers. The adhesive-lubricants of the present invention adhere strongly to these bearing areas and are not easily removed by environmental or operating conditions even after being squeezed out of the bearing area.

One base material is comprised of the following three components:

A. Polybutene and/or polybutylene, as defined in the KIRK-OTHMER ENCYCLOPEDIA QF CHEMICAL TECHNOLOGY, third edition, volume 4, page 370, and/or other similar adhesives and/or viscous non-drying liquid materials, with a final combined Saybolt Universal viscosity, ASTM D-2161 method of 500 SUS or more at 99° C.

B. Synthetic and/or mineral oil(s) and/or natural oil(s) and/or polyols and/or esters, having a final viscosity, using ASTM D-445 method, of between 2–60 centistokes at 150° C.

C. Thermoplastic polymer(s) and/or wax(es) with a melting point of between 160° F.–500° F.

This lubricant mixture may constitute 60 percent or more of the final product and as an example may be 80 percent or more.

A second series of base materials uses no oils. It is comprised of polybutene and/or polybutylene and/or other similar adhesives and/or viscous non-drying liquid polymer (s) with a final Saybolt Universal viscosity, ASTM D-2161 method of 500 SUS or more at 99° C. This material may constitute 40 percent or more by weight of the final product and in one example constitutes 50 percent or more by weight and where 80 percent or more by weight of the materials meet the above referenced Saybolt Universal viscosity.

A third series of base materials also uses no oil whatsoever. It is comprised of polybutene and/or polybutylene and/or other similar elastomeric(s) and/or viscous non-drying liquid polymer(s) together with thermoplastic polymer(s) and/or wax(es) with a melting point of between 160° F.–500° F. This material may constitute 50 percent or more by weight of the final product.

A fourth series of base materials comprises thermoplastic polymer(s) and/or wax(es) with a melting point of between 160° F.–500° F. and synthetic, natural and/or mineral oils and/or polyols and/or esters with the oil type materials having a blended viscosity of 2–60 centistokes at 150° C. SUS at method ASTM D-445. This material may constitute 50 percent or more by weight of the final product.

All of the above material base mixtures may have various additives including one or more of the following: Extreme pressure additives, anti-oxidants, anti-rust, anticorrosion additives, flow enhancing agents, surface tension depressants, graphite, metallic oxides, sulfides or stearates, metallic soaps, talc, mica, metal flake and/or powder and/or cotton, polyester, glass or other textile materials, clay and silica materials with or without activators.

These additional components may be present in amounts from 0–40 percent of total weight of the finished lubricant. Field research shows that obtaining the correct flow and adhesion of the lubricant material under oscillating load, a summer-winter ambient temperature range, and other operating conditions previously mentioned requires proper selection and combination of all materials.

The additional components as well as the components of the base mixture must be carefully constituted so as to also maximize resistance to emulsifying. Use of less than 5 percent by weight of any materials that may act as an emulsifying agent with water, salt, dirt or other material typically contacting this bearing area, or in combination or as part of materials in the base, additive or final combination of lubricant for use in the fifth wheel plate/king pin plate bearing area is an important consideration.

The invention will be better understood from the following specific example, which should not be construed as limiting:

| MATERIAL | % RANGES/ WEIGHT | % BY WEIGHT FOR SPECIFIC EXAMPLE |
|---|---|---|
| Polybutene as specified above | 40–60 | 58 |
| Oil as specified above | 20–40 | 24 |
| Thermoplastic resin(s) and/or wax(es)/polymer(s) as above | 5–30 | 12 |
| BASE MATERIAL SUBTOTAL | 70–100 | 94 |
| Additives from above list | 30–0 | 6 |

For example, a specific example may include antirust additives, an EP (Extreme Pressure) agent and a flow enhancing material as well as other additives to form the final 6 percent of the lubricant.

The above example of the lubricant of the present invention was prepared by heating the materials to 300° F. and agitating the materials at this temperature until fully blended. The resultant mixture was used after cooling. A further option is to pass the blended material through a grease mill or homogenizer. The use of this additional equipment depends in part on any additive materials used in addition to the base materials.

The above described lubricant was field tested in the fifth wheel plate/king pin plate bearing area with the following typical results: AMOUNT OF LUBRICANT applied to the bearing area: 1–1.5 oz, as compared to 7–14.5 oz. of grease usually applied. SERVICE LIFE (Time between applications): 5,000–10,000 miles, as compared to 2,500 miles with grease usually applied. CONDITION OF BEARING AREA when more lube was applied: 90 percent or more of the bearing area remained covered, since the lubricant adheres to the bearing area, as compared with 50 percent or less remaining if covered with grease. AMOUNT OF LUBRICANT RE-APPLIED to the bearing area: 1–1.5 oz. as compared to 7–14.5 oz. of grease usually applied. POLLUTION CONTROL: 95 percent by weight, or more, of lubricant used on this bearing area stayed in place and/or was easily recovered, compared to typically less than 5 percent for grease usually used. Grease washoff, grease dropoff and grease spray from this bearing to other portions of the truck and/or trailer, following vehicles, or grease drop to the road or ground are almost completely eliminated.

Referring back to the figure of 23–45 million pounds of grease pollution from the fifth wheel bearing area, a typical pollution reduction of 95 percent means up to about 21–43 million pounds per year of grease pollution can now be eliminated each year.

Research, compounding and testing of the present invention has been directed to develop base material and final lubricants that can be used directly without the requirement to add solvent for manufacturing, packaging, application or other purposes. The elimination of solvent has been done to obtain an even further environmentally friendly product that will also outperform current greases. However, solvents may be added to the base material or final products if so desired and amounts by weight herein are without solvents, if any.

A preferred adhesive-lubricant composition according to the present invention comprises an intimate admixture of the following materials:

about 25.0 wt. % polybutene (H1900) adhesive,
about 63.9 wt. % polybutene (H100) adhesive,
about 4.0 wt. % polyethylene wax thickener,
about 1.5 wt. % paraffinic wax water blocker,
about 5.0 wt. % anti-rust (Monacore 39),
about 0.1 wt. % florescent yellow colorant, and
about 0.5 wt. % methyl salicylate odorant.

Polybutene H1900 and H100 are clear liquid adhesives manufactured by Amoco Chemicals, Chicago, Ill. The viscosities of H100 and H1900, Kinematic, ASTMD445 at 210 degrees Fahrenheit, are 196–233, and 4,069–4,382 cSt, respectively. The flash points, Pensky-Martens closed cup, ASTM D93, are 311 and 338 degrees Fahrenheit, respectively. The average molecular weights, number average gel permeation chromatography, $M_n$, are 940 and 2270, respectively. The viscosity indices, ASTM D2270, are 115 and 270, respectively. The pour points are −7 and +18 degrees Centigrade, respectively. Evaporation loss, 10 hours at 210 degrees Fahrenheit, ASTM D972, is 0.6 and 0.1 weight percent, respectively. The two polybutenes are blended to achieve the desired viscosity and adhesion. Preferably, the polybutenes form about 80 to 90 weight percent of the adhesive-lubricant composition. In general, the other materials are minimized in this mixture so as to maximize hydrophobic nature of the adhesive lubricant and/or the degree of adhesion.

Monacore 39 is an ashless oil soluble corrosion inhibitor, manufactured by Mona Industries, Inc., Paterson, N.J. It is believed to be a dialkylester of an aminosuccinic acid. See Mathews et al. U.S. Pat. No. 4,462,918. Increasing the proportion of this rust inhibitor in the composition generally does not provide any significant improvement from the stand point of cost-benefit. The oxidation inhibitor tends to be more expensive per pound than most of the other ingredients. Any significant improvement in the oxidation inhibition function above approximately 5 weight percent is generally not justified by the increase in cost. The inclusion of from about 4 to 6 weight percent of this material in the composition provides the maximum advantage.

The optional florescent yellow is added to provide color to the composition so that the presence of an effective amount of adhesive lubricant on the bearing surface is evident at a glance. Any suitable colorant of any visible color can be used for this purpose, or it can be omitted if desired. The optional methyl salicylate is an odorizing agent (wintergreen). Any suitable odorizing agent of any desired odor can be employed, or it can be omitted if desired.

The quantity of thickening agent to be used is determined by the desired consistency of the finished admixture. In general, no more than about 2 to 6 weight percent of polyethylene wax is required to achieve the desired consistency.

The amount of water blocker which in useful in this formulation ranges from about 1 to 3 weight percent. Higher proportions of paraffinic wax tend to degrade the adhesiveness, and lower proportions tend to be less effective.

These ingredients are combined by heating and mixing them to about 190 degrees Fahrenheit. It is believed that no significant chemical reactions occur in this mixture. To avoid the risk of thermal degradation, the anti-rust, odorizer and colorant are added to the hot mixture just before the mixture is packaged and cooled. The mechanical mixture is then packaged and cooled. The composition is a sticky paste which will not flow at room temperature (75 degrees Fahrenheit). This adhesive-lubricating composition is fluid in the sense that it can be spread into an adhesive-lubricating film on a bearing surface. It is preferably packaged in units of about, for example, 3 ounces each, which is generally sufficient to lubricate, for example, one fifth wheel bearing. The application of excessive amounts of the adhesive-lubricating composition is thus discouraged.

This formulation is designed to provide an environmentally benign composition which adheres tightly to low speed bearing surfaces, such as, for example, fifth wheel bearings, provides lubricant to these open, low speed, heavily loaded bearing surfaces, and resists the environmental factors to which these bearing surfaces are exposed. The amount of this composition which is required to accomplish these results is generally less than about 5 percent that of the greases which had previously been used. The protection afforded lasts longer, and is more effective, than conventional greases. There are no significant volatile organic compounds emitted from this composition.

The mix of ingredients of this composition is very hydrophobic. The fifth wheel on a truck, for example, does not rotate through a very large arc, but it does oscillate slowly (typically less than 6 inches per second) under very substantial loads. This produces a grinding action between the two bearing plates which is ideal for the emulsification of compositions when water is present. Moisture is frequently present when fifth wheels are in use on the road, as well as in many other applications. Previously used greases, particularly when water and dirt are present, tend to emulsify when used to lubricate fifth wheel bearings, and other bearing surfaces where moisture is present. The very hydrophobic nature of the present composition substantially prevents emulsification.

There are substantial shearing loads imposed on the lubricants for slow speed, high load bearings, such as, for example, fifth wheel bearings. The strength of the adhesive bond under shear of the lubricant to the juxtaposed bearing surfaces of the bearings must be greater than the shear strength of the film of adhesive-lubricant. If it is not, the adhesive-lubricant will be removed from the bearing surfaces by the shear load, and the unprotected surfaces will grind against one another.

The degree of adhesion in shear of the composition of the present invention to the bearing surfaces is such that it exceeds the shear strength of the film of adhesive-lubricant. The degree of adhesion and the shear strength are not absolute values. So long as they are relative to one another, with the strength of the adhesive bond under shear to the bearing surfaces being greater than the shear strength of the film within itself, the desired effect is achieved. When open bearing surfaces are exposed to dirt and debris the shear strength of the adhesive lubricant increases with the build up of these filler materials. Eventually, the filler load becomes such that the shear strength within the film itself exceeds the bond strength under shear, and the lubricant fails. Before this happens, the film of lubricant should be replaced or added to.

It has been found that the presence of rust on ferric bearing surfaces, even a light flash of rust, will prevent the composition from adhering to the plates strongly enough to resist the shear loads. Oxidation products that are not firmly attached to the bearing surface will cause the composition to release from the bearing surface before it shears. Typically, when oxidation products are present on the bearing surfaces, the film of adhesive lubricating composition comes off of the bearing surfaces long before the expiration of its normal expected service life. According to these preferred embodiments, the use of hydrophobic materials is not, in and of itself, enough to prevent the formation of adhesion destroying oxides, such as, for example, rust. Effective amounts of one or more effective oxidation inhibitors must also be present in these preferred compositions.

Suitable oxidation inhibitors include those which are effective in amounts of less than approximately 10 weight percent, and preferably in amounts of less than about 5 weight percent. Whether an oxidation inhibitor is effective can be determined by subjecting, for example, a fifth wheel bearing surface which is covered by a film of adhesive-lubricant containing the oxidation inhibitor to periodic water flushings during otherwise normal use. If the film of adhesive-lubricant comes off of the bearing surfaces well before the end of the films normal service life, the oxidation inhibitor is ineffective. The above described Monacor 39 containing composition can be used to determine the normal expected service life of the film of adhesive-lubricant. In general, a service life of less than about two thirds of the normal expected life indicates an ineffective oxidation inhibitor. In general, if an oxidation inhibitor is ineffective at about 5 to 10 weight percent, its effectiveness usually will not be substantially improved by increasing its proportion in the composition to as much as 15 or 20 weight percent because of increase in cost and likely loss of adhesive bond strength in shear.

The conditions of operation for many slow speed heavily loaded bearings, such as fifth wheels, are such that significant heat is not generated by the slow relative motion between the bearing surfaces. Also, the large mass of such bearings tends to dissipate most of the heat which is generated. Thus, the lubricating compositions need only be capable of withstanding those ambient temperatures which are typically found in service on the highways and other exposed environments (rarely higher than 140 degrees Fahrenheit).

Because the relative movement between heavily loaded slow speed bearing surfaces is slow, the lubricity of the composition need not be very great. Also, in general, resistance to relative movement between the bearing surfaces by reason of low lubricity is of no significant concern. The lubricity which is required is that which is sufficient to separate and protect the bearing surfaces from contact with one another. Thus, while the layer of adhesive-lubricant between the bearing surfaces must shear within itself rather than coming off of the bearing surfaces, it need not have a low coefficient of friction. The affinity or adhesion of the composition to the bearing surface must be greater than its shear strength. It has been found that under these conditions, a non-drying adhesive provides all of the lubricity which is necessary. Having discovered this, the compositions of the present invention according to these preferred embodiments are optimized for adhesion, especially in the presence of moisture, rather than lubricity.

The mechanical adhesion of the present preferred compositions is optimized by selecting an effective amount of a non-drying adhesive base which strongly adheres to the bearing surfaces, and incorporating additional materials which prevent the formation of oxidation products, and which render the composition as impermeable as possible to moisture. The term "non-drying" as used herein is intended to include those adhesives which do not solidify over time into solids, whether they include solvents or not. This term is intended to indicate that the composition remains a highly viscous liquid or fluid (whether flowable at room temperature or not), rather than to indicate that only one particular means of solidification is excluded. Paint is an example of an adhesive which forms a solid coating, and which is intended to be excluded by the term "non-drying".

The adhesive base, according to these preferred compositions, should be environmentally benign, hydrophobic, viscous, non-drying, inherently adhesive to metallic bearing surfaces with a force which is greater than its shear strength. Polybutenes (preferably those having at least approximately 300,000 SUS, Saybolt Universal, ASTM D2161, at 100 degrees Fahrenheit) have been found to meet these criteria, and they are generally preferred, however, many other adhesive base materials may be used, alone or in combination with one another. Adhesive base materials which may be used include, for example, organic polymers such as, for example, polybutenes, polyisobutylenes, monomers, synthetic and natural resins and rosins, mixtures thereof, and the like. Adhesive base materials generally comprise the majority of the composition, and preferably they comprise at least 60 weight percent of the adhesive-lubricant composition.

Effective amounts of various moisture blocking materials, according to these preferred embodiments, are useful in rendering adhesive lubricating films formed from the compositions of the present invention as water impermeable as possible. These include, for example, waxes, non-porous flakes, some pigments, mixtures thereof, and the like. Suitable non-porous flakes include, for example, aluminum, zinc and stainless steel flakes, and the like. The action of these materials appears to be primarily mechanical in blocking or lengthening those miniscule pathways in the composition through which moisture can migrate. These moisture blocking materials generally comprise only a minor portion of the composition, for example, less than approximately 10 weight percent, and preferably less than about 5 weight percent. In general, if these moisture blocking materials have an adverse impact on the adhesion of the composition to the bearing surfaces their quantities are minimized.

Even in the absence of moisture, oxygen in the air may cause the oxidation of any unprotected bearing surfaces. The environments in which these compositions are generally used, however, are such that moisture is almost always present under conditions where its effect far outweighs any problem with oxygen alone. The moisture blocking materials generally also serve to at least partially block the passage of oxygen through the adhesive film.

The viscosity of the composition is very high, inter alia, so that it stays in place on open bearings and enjoys a compressive strength which is sufficient to sustain the substantial compressive loads (10,000 pounds or more) which are imposed on slow speed heavily loaded bearings, such as, for example, fifth wheel bearings.

Effective amounts of viscosity adjusting materials can be used, if desired, according to the present preferred embodiments. The nature and quantities of such materials are selected so that they do not significantly impair the adhesion, oxidation prevention, or moisture blocking capabilities of the other materials. In general, such viscosity adjusting materials are employed to increase the viscosity of the composition, although they can be employed, if desired, to reduce the viscosity of the composition. Suitable thickening agents include, for example, fumed silica, polyethylene, clays such as bentonite, pigments, mixtures thereof, and the like. When used, these viscosity adjusting materials are employed in minor amounts, generally less than about 10 and preferably less than 5 weight percent.

The solution to the problem of providing an effective, environmentally benign lubricant for slow speed, heavily loaded bearings, particularly open bearings, such as, for example, fifth wheel bearings, has been found to be more mechanical than chemical. The solution is based on the discovery that adhesion is more important than lubricity, and oxidation products are a primary cause of loss of adhesion and resulting lubrication failure.

There are other applications where conditions are similar to those encountered in fifth wheel bearings. These other applications include, for example, the bearing surfaces used in raising and lowering draw bridges, opening and closing canal locks, dam water slides, construction equipment, garbage trucks, ball and socket hitches, tracks and conveyors, shopping carts, and the like. Bearing surfaces include any surfaces which have relative motion, such as, for example, cams, gears, and relatively sliding, oscillating and rotating surfaces, and the like.

Typically, the low speed bearing surfaces which are protected by the compositions according to the present invention include those which have a substantial oxidizable metal content, such as, for example, iron, zinc, aluminum, or the like.

The low speed bearing surfaces to which the adhesive-lubricant of the present invention is particularly applicable are those in which the relative motion between the surfaces does not generate significant heat. The generation of significant heat is generally indicated by a maintained rise in temperature of more than approximately 30 degrees over ambient temperature over a significant portion of the bearing surface.

Although this invention has been described with reference to a particular embodiment, it is to be appreciated that various adaptations and modifications may be made and the invention is only to be limited by the appended claims.

What is claimed is:

1. A hydrophobic, non-drying, fluid adhesive-lubricant for low speed, high load, bearing surfaces comprising a mixture of:

a non-drying liquid adhesive having a bond strength under shear to said bearing surfaces and a viscosity of at least about 300,000 SUS at 100 degrees Fahrenheit;

an effective amount of an effective oxidation inhibitor to prevent the formation of an oxide on said bearing surfaces;

an effective amount of a moisture blocking material to render said lubricant substantially impervious to moisture, and said adhesive-lubricant having a shear strength which is less than said bond strength, and a compressive strength which is sufficient to withstand compressive loads in excess of 10,000 pounds.

2. A hydrophobic, non-drying, fluid adhesive-lubricant for low speed, high load, bearing surfaces comprising a mixture of:

a non-drying liquid adhesive comprising polybutene having an affinity for adhesion to said bearing surfaces under shear, and a viscosity of at least about 300,000 SUS at 100 degrees Fahrenheit, said polybutene comprising a majority of said adhesive lubricant;

an effective amount of an effective oxidation inhibitor to prevent the formation of an oxide on said bearing surfaces; and an effective amount of a moisture blocking material to render said lubricant substantially impervious to moisture; and said adhesive-lubricant having a shear strength which is less than the strength of its adhesive bond to said bearing surfaces, and said adhesive-lubricant having a shear strength which is less than said bond strength, and a compressive strength which is sufficient to withstand compressive loads in excess of 10,000 pounds.

3. A hydrophobic, non-drying, fluid adhesive-lubricant for low speed, high load, bearing surfaces of claim 1 wherein said oxidation inhibitor comprises a dialkylester of an aminosuccinic acid.

4. A hydrophobic, non-drying, fluid adhesive-lubricant for low speed, high load, bearing surfaces of claim 1 wherein said oxidation inhibitor comprises less than about 10 weight percent of said adhesive-lubricant.

5. A hydrophobic, non-drying, fluid adhesive-lubricant for low speed, high load, bearing surfaces of claim 1 wherein said moisture blocking material comprises less than about 10 weight percent of said adhesive-lubricant.

6. A hydrophobic, non-drying, fluid adhesive-lubricant for low speed, high load, bearing surfaces of claim 1 wherein said adhesive-lubricant includes less than about 10 weight percent of a thickening agent.

7. An oxidizable low speed bearing surface having a lubricating film of hydrophobic, non-drying, fluid adhesive-lubricant thereon, said lubricating film comprising:

a non-drying liquid adhesive having an affinity for adhesion to said bearing surfaces under shear, and a viscosity of at least about 300,000 SUS at 100 degrees Fahrenheit;

an effective amount of an effective oxidation inhibitor to inhibit the formation of an oxide on said bearing surfaces;

an effective amount of a moisture blocking material to render said lubricant substantially impervious to moisture;

said adhesive-lubricant having a shear strength which is less than the strength of its adhesive bond to said bearing surfaces, and said adhesive-lubricant having a shear strength which is less than said band strength, and a compressive strength which is sufficient to withstand compressive loads in excess of 10,000 pounds.

8. An oxidizable low speed bearing surface of claim 7 wherein said bearing surface is in an open bearing.

* * * * *